US006660044B2

(12) United States Patent
Igarashi et al.

(10) Patent No.: US 6,660,044 B2
(45) Date of Patent: Dec. 9, 2003

(54) FIBER PRODUCT-TREATING AGENTS

(75) Inventors: Takako Igarashi, Wakayama (JP); Koji Yui, Wakayama (JP); Miki Hasegawa, Tokyo (JP); Yasushi Yoshida, Wakayama (JP)

(73) Assignee: Kao Corporation, Tokyo (JP)

( * ) Notice: Subject to any disclaimer, the term of this patent is extended or adjusted under 35 U.S.C. 154(b) by 116 days.

(21) Appl. No.: 09/820,992

(22) Filed: Mar. 30, 2001

(65) Prior Publication Data

US 2001/0037529 A1 Nov. 8, 2001

(30) Foreign Application Priority Data

Mar. 31, 2000 (JP) ..... 2000-097642

(51) Int. Cl.[7] ..... D06M 15/00

(52) U.S. Cl. ..... 8/115.51; 8/115.6; 8/128.1; 8/128.3; 510/276

(58) Field of Search ..... 8/115.6, 115.51, 8/128.1, 128.3; 510/276

(56) References Cited

U.S. PATENT DOCUMENTS

| | | | | |
|---|---|---|---|---|
| 2,752,269 A | | 6/1956 | Condo et al. | 117/139.4 |
| 4,076,870 A | | 2/1978 | Yamamoto | 427/390 |
| 4,689,159 A | | 8/1987 | Makashima | 252/8.6 |
| 4,987,180 A | * | 1/1991 | Ohata et al. | 524/860 |
| 5,137,963 A | | 8/1992 | Stack | 524/519 |
| 5,427,587 A | | 6/1995 | Arkens et al. | 8/116.1 |

FOREIGN PATENT DOCUMENTS

| | | | | |
|---|---|---|---|---|
| EP | A651088 | | 3/1995 | |
| JP | 05059662 A | | 3/1993 | |
| JP | A726321 | | 3/1995 | |
| JP | A7189131 | | 7/1995 | |
| JP | A11158773 | | 6/1999 | |
| JP | 11158773 A | | 6/1999 | |
| JP | 11158773 | * | 6/1999 | ..... D06M/15/267 |
| WO | WO 8912714 | | 12/1989 | |

* cited by examiner

*Primary Examiner*—Yogendra N. Gupta
*Assistant Examiner*—Eisa Elhilo
(74) *Attorney, Agent, or Firm*—Birch, Stewart, Kolasch & Birch, LLP

(57) ABSTRACT

The present invention provides a fiber product-treating agent which can impart an excellent wrinkle-resistant effect and an excellent durable press effect to the fiber product capable of being heated and being hardly effected with not only during wearing but also after washing. That is, the present invention provides the treating agent for imparting the durable press configuration on a fiber product by a heating treatment with e.g. an iron, which comprises a specific amount of (i) two or more compounds forming mutually a crosslinked structure by heating and/or (ii) a compound forming a self-crosslinked structure by heating, and water, wherein the content of a nonvolatile matter is 0.01 to 30%.

7 Claims, No Drawings

FIBER PRODUCT-TREATING AGENTS

TECHNICAL FIELD

The present invention relates to a fiber product-treating agent for imparting (conferring or giving) an excellent durable press configuration such as a wrinkle-resistant effect and a durable press effect on the fiber product by a heating treatment with e.g. an iron after an application thereof.

PRIOR ART

An ironing on a shirt, a slack or the like is one of cumbersome operations. For relieving the operation, clothes subjected to a treatment imparting a durable press configuration with gaseous formaldehyde, a formaldehyde-releaser, liquid ammonia or the like are commercially available. Further, JP-B 7-26321 discloses a method for esterifying a polycarboxylic acid and cellulose and crosslinking the resultant ester by impregnating fibrous cellulose materials with a treatment solution containing a specific polycarboxylic acid and a specific curing catalyst and then heating them. Further, JP-A 7-189131 discloses a method for reinforcing a cellulose substrate containing a polyacid having at least two carboxy groups, a phosphorus-containing promoter (or accelerator) and an active hydrogen compound. On the other hand, JP-A11-158773 discloses a method for imparting a durable press configuration on a cellulose fabric with an aqueous solution comprising a specific water-soluble vinyl copolymer and an inorganic salt.

However, any effect of these methods is obtained by an ester-crosslink between a carboxylic acid and a hydroxyl group of cellulose. Thus, these are techniques useful for only fabrics and clothes (referred to collectively as cloths) having a high content of cellulose and no effect is recognized for cloths made of cellulose-free chemical fibers or wools or there is the problem that insufficient effect can be obtained for cloths having a low content of cellulose.

DISCLOSURE OF THE INVENTION

The invention relates to a fiber product-treating agent for imparting a durable press configuration by heating, which comprises 0.01 to 20 percent by mass of at least one of (i) two or more compounds forming mutually a crosslinked structure by heating and (ii) a compound forming a self-crosslinked structure by heating, and water, wherein the content of a nonvolatile matter is 0.01 to 30%.

The agent of the invention may include the balance of water.

The invention may include a concentrate of the above shown agent, which can be used by diluting it with water. The agent of the invention can be used by applying it to a fiber product, for example by spraying, impregnating, immersing or bathing, and heating the product while imparting a configuration to effect the crosslinking with heat and obtain a durable press configuration. The heating may be conducted with an iron, a presser for trousers or a pressing machine.

Further, the present invention relates to a fiber product-treating agent for imparting a durable press configuration by a heating treatment, which comprises 0.01 to 20 percent by mass of a vinyl polymer containing a monomer unit selected from the following monomer units (A), (B) and (C) (provided that if the monomer unit (C) is not selected, both of the monomer units (A) and (B) are selected), wherein the ratio of a sum of the monomer units (A), (B) and (C) is 50 to 100 mol-% of the total constituent monomer units, and the content of a nonvolatile matter is 0.01 to 30%:

the monomer unit (A): a vinyl monomer unit having a carboxy group, the monomer unit (B): a vinyl monomer unit having a hydroxyl group, and the monomer unit (C): a vinyl monomer unit having a carboxy group and a hydroxyl group.

The present invention includes the fiber product-treating agent which comprises 0.01 to 20 percent by mass of a vinyl polymer containing a monomer unit selected from the above-mentioned monomer units (A), (B) and (C) (provided that if the monomer unit (C) is not selected, both of the monomer units (A) and (B) are selected), wherein the ratio of a sum of the monomer units (A), (B) and (C) is 50 to 100 mol-% of the total constituent monomer units and whose pH value at 20° C. is 3.0 to 7.5.

In the present invention, the terms "self-crosslink" refers to a phenomenon in which the same kinds of a compound form a three-dimensional structure without a crosslinking agent and the terms "self-crosslinked structure" refers to a structure formed by the self-crosslink. The terms "the same kinds" refers to a combination of identical constitutional monomers in the polymer.

Furthermore, the crosslink in the present invention refers to a crosslink based on a covalent bond formed by mainly heating and then the crosslink makes a contribution to the durable press configuration. It is thinkable in the present invention that a crosslink formed by merely an evaporation of water makes no contribution practically to the durable press configuration.

When there are used (i) the above-mentioned two or more compounds forming mutually a crosslinked structure by heating, the durable press configuration can be obtained by forming a crosslinked structure of not only chemical fibers, wools and the like but also cellulose-containing fibers in the same way.

For example, (ii) the compound forming a self-crosslinked structure by heating includes the above-described vinyl polymer having a carboxy group and a hydroxyl group in one molecule. In this case, by conducting a heating treatment, such polymers can form an intramolecular or intermolecular self-crosslinked structure and can further form a crosslink with a cellulose molecule. Accordingly, the durable press configuration by the self-crosslink can be obtained even with a fiber product made of e.g. a cellulose-free chemical fiber or wool, while, with regard to a cellulose-containing fiber product, the higher durable press configuration can be obtained because of forming both of the self-crosslink and a crosslink with cellulose.

As shown above, the treating agent of the present invention can be used in order to obtain the durable press configuration regardless of the type of fibers even on a blended fabric or a mixed fiber spinning.

The invention provides a method of imparting a durable press configuration to a fiber product, which comprises applying, to the fiber product, the treating agent as defined above and heating it while imparting a configuration to impart the durable press configuration.

The durable press configuration may have a resistance to wrinkles, shrinks or creases or a smooth drying property. Alternatively it means a wash-wear property.

The smooth drying property is to obtain a dried fiber product being flat without wrinkles, shrinks or creases. The wash-wear property is wash and wear, that is, to obtain a fiber product such as clothing to wear without further heating, after washing and drying.

The invention can be applied to a fiber product such as a clothing product, yarns, fabrics, textile and a fiber article.

The invention provides a method of treating the fiber product with the treating agent as above defined.

The invention can impart a durable press configuration to a fiber product, a clothing product, a yarn product, soft goods or a textile product.

Modes for Carrying Out the Invention

In the treating agent of the present invention, at least one constituting the above-mentioned (i) or (ii) is preferably a polymer having a weight average molecular weight of 1,000 to 1,000,000. In this case, among the monomer units constituting the polymer, a monomer unit having at least one hydroxyl or carboxy group occupies preferably from 50 to 100 mol-% of the total monomer units. In addition, (ii) preferably contains a polymer having both of a hydroxyl group and a carboxy group. Further, the equivalent ratio of the carboxy group and the hydroxyl group, namely the carboxy group:the hydroxyl group, in the polymer at the case (ii) is preferably from 9:1 to 1:9.

Further, the treating agent of the present invention preferably comprises 0.005 to 10 percent by mass of a water-soluble inorganic salt.

Furthermore, the treating agent of the present invention preferably comprises 0.005 to 7.5 percent by mass of a silicone compound.

In the present invention, (i) or (ii) is one which preferably satisfies both of the following requirements (I) and (II):

the requirement (I): a value $r^1$ (%) determined by $(M^2/M^1)\times100$ is in the range of from 40 to 100% for a fabric made of polyester fibers, wherein $M^1$ is made as an increase in mass of the fabric as compared with the untreated fabric after a 30 mass-percent aqueous solution of (i) or (ii) is applied onto the fabric and heated at 180° C. for 10 minutes and $M^2$ is made as an increase in mass of the fabric as compared with the untreated fabric after the said heated fabric is immersed (or dipped) in deionized water for 2 hours and then dried at 60° C. for 2 hours; and the requirement (II): a value $r^2$ (%) determined by $(M^4/M^3)\times100$ is less than 20% for a fabric made of polyester fibers, wherein $M^3$ is made as an increase in mass of the fabric as compared with the untreated fabric after a 30 mass-percent aqueous solution of (i) or (ii) is applied onto the fabric and calmly left-dried at 20° C. for 48 hours, and $M^4$ is made as an increase in mass of the fabric as compared with to the untreated fabric after the above-mentioned calmly left-dried fabric is immersed in deionized water for 2 hours and then dried at 60° C. for 2 hours.

For measurement of the requirements (I) and (II), a cloth made of a 100-% polyester, wherein the mass of pieces cut into 2.0 cm×5.0 cm is 1.0 to 3.0 g per 100 $cm^2$, is used as a test-cloth. It is more than enough that any polyester fabric in this range satisfies the present requirements. In the present invention, a jersey cloth made of a 100-% polyester (available from SENSHOKU SHIZAI COMPANY, LTD. (TANIGASHIRA SHOTEN)) cut into 2.0 cm×5.0 cm pieces was used as the fabric satisfying these requirements in the measurement. The masses of the all test-cloths are measured after regulating the humidity thereof for 12 hours or more under the conditions of 20° C. and 65% R.H. Further, they are heated at 180° C. and dried at 60° C. in a thermostatic oven (with the temperature set at 180±5° C. and 60±5° C. respectively).

(i) Two or more compounds forming mutually a crosslinked structure by heating include preferably polymers. In particular, a combination of an anionic polymer and a multifunctional epoxy compound is exemplified.

The anionic polymer in this combination is a polymer containing a constituent unit having an anionic group such as carboxy group, sulfonate group, sulfate group, phosphate group and phosphonate group. The anionic polymer may be any of a polymer obtained by polymerizing anionic group-containing monomers, a polymer to which anionic groups are introduced by e.g. addition, and a polymer existing naturally.

Specific examples of the anionic group-containing monomers include acrylic acid, methacrylic acid, itaconic acid, crotonic acid, maleic acid, fumaric acid, styrenesulfonic acid, 2-acrylamide-2-methylpropanesulfonic acid, allyl sulfonic acid, vinyl sulfonic acid, methallyl sulfonic acid and mono-10-methacryloyloxydecyl phosphate as well as a salt thereof. The anionic polymer is obtained by polymerizing one or more members of these monomers and/or the other monomer.

Further, the anionic polymer formed by e.g. adding anionic groups to a polymer includes carboxymethyl-starch, carboxymethyl-cellulose and a salt thereof. Furthermore, there can also be used alginic acid existing naturally, a salt thereof, etc.

On the other hand, the multifunctional epoxy compound used in combination with the anionic polymer includes a fatty polyhydric alcohol polyglycidyl ether such as (poly) ethylene glycol diglycidyl ether, (poly)propylene glycol diglycidyl ether, diglycerol triglycidyl ether, tetraglycerol tetraglycidyl ether and pentaerythritol polyglycidyl ether.

In the combination of the anionic polymer and the multifunctional epoxy compound described above, the ratio between the both members, namely the anionic polymer/the multifunctional epoxy compound, is preferably from 50000/1 to 10/1, more preferably from 10000/1 to 20/1 and most preferably from 1000/1 to 50/1 by mass.

The compound (ii) forming a self-crosslinked structure by heating is preferably a polymer. As this polymer, there is exemplified a polymer having both of a hydroxyl group and a carboxy group. Among them, there is preferably a polymer obtained by polymerizing hydroxyl group-containing monomers with carboxy group-containing monomers or one in which carboxy groups are added to polysacchuarides such as cellulose and starch, for example, carboxymethyl-cellulose and carboxymethyl-starch.

In particular, a vinyl polymer comprising a vinyl monomer unit having a carboxy group and a vinyl monomer unit having a hydroxyl group is preferable. This vinyl polymer includes a vinyl polymer comprising a monomer unit selected from the following monomer units (A), (B) and (C) (provided that if the monomer unit (C) is not selected, both of the monomer units (A) and (B) are selected), wherein the ratio of a sum of the constituent monomer units (A), (B) and (C) is 50 to 100 mol-%:

the monomer unit (A): a vinyl monomer unit having a carboxy group, the monomer unit (B): a vinyl monomer unit having a hydroxyl group, and the monomer unit (C): a vinyl monomer unit having a carboxy group and a hydroxyl group.

Examples of the vinyl monomer (A) for obtaining the monomer unit (A) having a carboxy group include one or more members selected from the compounds represented by the following formula (1) to (3):

(1)

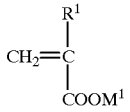

(2)

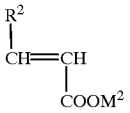

(3)

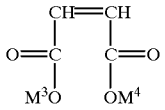

wherein $R^1$ and $R^2$ are the same or different and each thereof represents a hydrogen atom and an alkyl group having 1 to 3 carbon atoms or $CH_2COOM^5$, in which $M^5$ is a hydrogen atom, an alkali metal, an alkaline earth metal, $NH_4$ or an organic amine; $M^1$, $M^2$, $M^3$ and $M^4$ are the same or different and each thereof represents a hydrogen atom, an alkali metal, an alkaline earth metal, $NH_4$ or an organic amine, whereupon the organic amine includes monoethanolamine, diethanolamine and triethanolamine.

Specific examples represented by the formulae (1), (2) and (3) include acrylic acid, methacrylic acid, itaconic acid, crotonic acid, maleic acid and fumaric acid as well as a salt thereof. The salts include those with sodium, potassium, lithium, ammonium, monoethanolamine, diethanolamine and triethanolamine. Itaconic acid or maleic acid may be an acid anhydride represented by formulae (4) and (5) below. The acid anhydride is hydrolyzed into a monomer unit constituting the polymer of the present invention.

(4)

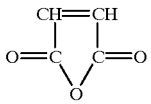

(5)

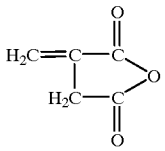

Among those described above, there is preferable acrylic acid, methacrylic acid, maleic acid or itaconic acid or a salt thereof with sodium or potassium. In particular, there is more preferable a dicarboxylic acid such as maleic acid, a salt thereof with sodium or potassium, or a maleic or itaconic anhydride.

Examples of the vinyl monomer (B) used for obtaining the monomer unit (B) having a hydroxyl group, used for obtaining the vinyl polymer of the present invention, include one or more compounds represented by the following formulae (6), (7), (8), (9), (10) and (11):

(6)

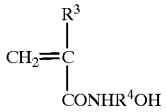

(7)

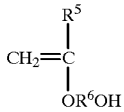

(8)

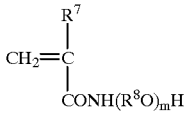

(9)

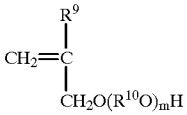

(10)

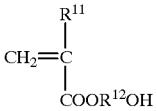

(11)

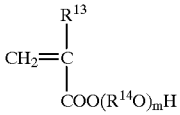

wherein $R^3$, $R^5$, $R^7$, $R^9$, $R^{11}$ and $R^{13}$ are the same or different and each thereof represents a hydrogen atom or an alkyl group having 1 to 100 carbon atoms; $R^4$, $R^6$, $R^8$, $R^{10}$, $R^{12}$ and $R^{14}$ are the same or different and each thereof represents an alkylene group having 2 to 6 carbon atoms; and m is an average number of added moles and represents a number selected from 2 to 100.

Specific examples represented by the formula (6) include a $C_{2-6}$hydroxyalkyl (meth)acrylamide such as N-(2-hydroxyethyl) (meth)acrylamide, N-(3-hydroxypropyl) (meth)acrylamide, N-(2-hydroxypropyl) (meth)acrylamide, N-(4-hydroxybutyl) (meth)acrylamide and N-(6-hydroxyhexyl) (meth)acrylamide. Here, the term "(meth) acryl" means acryl or methacryl. Specific examples represented by the formula (7) include hydroxyethyl vinyl ether and hydroxybutyl vinyl ether. Specific examples represented by the formula (8) include a polyoxyalkylene adduct to (meth)acrylamide which is obtained by using one or more members of e.g. oxyethylene (referred to hereinafter as EO) and oxypropylene (referred to hereinafter as PO) such as polyoxyethylene (meth)acrylamide and polyoxypropylene (meth)acrylamide. Specific examples represented by the formula (9) include a polyoxyalkylene adduct to (meth)allyl ether which is obtained by using one or more members of e.g. EO and PO such as polyoxyethylene (meth)allyl ether and polyoxypropylene (meth)allyl ether. Specific examples represented by the formula (10) include a $C_{2-6}$ hydroxyalkyl (meth)acrylate such as 2-hydroxyethyl (meth)acrylate, 3-hydroxypropyl (meth)acrylate, 2-hydroxypropyl (meth) acrylate, 4-hydroxybutyl (meth)acrylate and 6-hydroxyhexyl (meth)acrylate. Specific examples represented by the formula (11) include a polyoxyalkylene adduct to (meth)acrylic acid which is obtained by using one or more members of e.g. EO and PO such as polyoxyethylene (meth)acrylate and polyoxypropylene (meth)acrylate.

When $R^3$, $R^9$, $R^7$, $R^9$, $R^{11}$ or $R^{13}$ in formulae (6), (7), (8), (9), (10) and (11) is an alkyl group, the number of carbon atoms therein is preferably 1 to 22 and more preferably 1 to 5. In formulae (8), (9) and (11), the average number m of added moles of polyoxyalkylene is preferably 2 to 50.

In the present invention, the monomer unit (C) having both of a carboxy group and a hydroxyl group may or may not be coexistent with the monomer unit (A) and/or (B). The equivalent ratio of the carboxy group to the hydroxyl group therein is calculated in consideration of that, when the monomer unit (C) has both of a carboxy group and a hydroxyl group, each of the groups is present in 1 equivalent. Specific examples of the vinyl monomer (C) used for obtaining such monomer unit (C) include α-hydroxyacrylic acid.

The vinyl polymer of the present invention may have a monomer unit (D) other than the monomer units (A), (B) and (C). Specific examples of the vinyl monomer (D) for obtaining such monomer unit (D) include a (meth)acrylic acid derivative such as methyl (meth)acrylate and ethyl (meth) acrylate, a N-substituted (meth)acrylamide derivative such as N,N-dimethyl acrylamide, N,N-diethyl acrylamide, isopropyl acrylamide and tert-butyl acrylamide, a monoalkyl ether of a polyoxyalkylene adduct to (meth)acrylic acid represented by the formula (12), a monoalkyl ether of a polyoxyalkylene adduct to (meth) acrylic acid amides represented by the formula (13), and a monoalkyl ether of a polyoxyalkylene adduct of (meth)allyl alcohol represented by the formula (14):

(12)

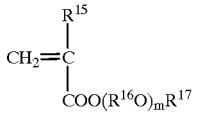

(13)

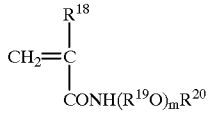

(14)

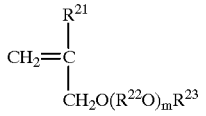

wherein $R^{15}$, $R^{18}$ and $R^{21}$ are the same or different and each thereof represents a hydrogen atom or an alkyl group having 1 to 100 carbon atoms; $R^{17}$, $R^{20}$ and $R^{23}$ are the same or different and each thereof represents an alkyl group having 1 to 100 carbon atoms; $R^{16}$, $R^{19}$ and $R^{22}$ are the same or different and each thereof represents an alkylene group having 2 to 6 carbon atoms; and m is an average number of added moles and represents a number selected from 2 to 100.

When $R^{15}$, $R^{17}$, $R^{18}$, $R^{20}$, $R^{21}$ or $R^{23}$ in the formulae (12), (13) and (14) is an alkyl group, the number of carbon atoms therein is preferably 1 to 22. The average number m of added moles of polyoxyalkylene is preferably 2 to 50.

The vinyl monomer (D) includes vinyl ethers such as methyl vinyl ether and butyl vinyl ether, styrene, a styrene derivative such as styrenesulfonic acid and a salt thereof, olefinic hydrocarbons such as ethylene and propylene, sulfonic acid group-containing vinyl monomers such as vinyl sulfonic acid and allyl sulfonic acid, or a salt thereof. When these monomers are used as salts, preferable salts are the same as used in the formulae (1), (2) and (3).

In the vinyl polymer used in the present invention, the sum of the monomer units (A), (B) and (C) is 50 to 100 mol-%, preferably 60 to 100 mol-% and more preferably 70 to 100 mol-% of the total constituent monomer units. The equivalent ratio of the carboxy group and the hydroxyl group, namely the carboxy group:the hydroxyl group, in the said vinyl polymer is preferably from 9:1 to 1:9, more preferably from 8:2 to 1:9 and most preferably from 7:3 to 2:8. Here, the acid anhydride represented by the formulae (4) and (5) is made to have the carboxyl group in 2 equivalents. This ratio may be one determined from the ratio of the vinyl monomers by amount used in polymerization (the molar ratio of the charged monomers).

When one or more vinyl monomers represented by the formulae (10) and (11) are made as the monomer units constituting the polymer of the present invention, the monomer unit (A) represented by the formulae (1), (2), (3), (4) and (5) is preferably 5 to 50 mol-% and more preferably 5 to 45 mol-% in the polymer. In this range, intramolecular or intermolecular crosslink of the vinyl polymer is formed more efficiently to obtain a higher durable press configuration without regard to the type of fibers.

As the method of synthesizing the vinyl polymer used in the present invention, there can be applied a method as described in JP-A 6-206750 for example. Specifically, it is obtained by radical copolymerization of each of the above-described monomers at a predetermined molar ratio in the presence of a radical initiator. The weight average molecular weight of the vinyl polymer thus obtained is preferably in the range of from 1,000 to 1,000,000 [determined by a gel permeation chromatography (referred to hereinafter as GPC) with a liquid carrier converted to a polyethylene glycol (referred to hereinafter as PEG) basis] to be used. In particular, it is more preferably in the range of from 5,000 to 800,000 and most preferably 10,000 to 500,000.

In the present invention, the above-described vinyl polymers having two or more different compositions or different weight average molecular weights can also be used in combination.

The treating agent of the present invention means a treating agent just for applying to fabrics. For example, if a stock solution is directly used in a treatment by spraying, coating or immersing, the stock solution is the treating agent, while if it is diluted to be used in a treatment by spraying, coating or immersing, the diluted solution is the treating agent.

The treating agent of the present invention may comprise both of (i) and (ii) described above. On the other hand, it may comprise both of one or more compounds constituting (i) and (ii). That is, when (i) is the compounds X and Y, either X or Y and (ii) can be used in combination. In the treating agent of the present invention, the above-mentioned (i) and/or (ii) [where is (i) in total] is comprised in an amount of 0.01 to 20 percent by mass, preferably 0.1 to 15 percent by mass and more preferably 0.5 to 10 percent by mass. In this range, the high durable press configuration is obtained.

In consideration of the vinyl polymer in the same way as described above, the vinyl polymer, further another compound forming a self-crosslinked structure by heating and/or two or more compounds forming mutually a crosslinked structure by heating are comprised in an amount of 0.01 to 20 percent by mass, preferably 0.1 to 15 percent by mass and more preferably 0.5 to 10 percent by mass of the treating agent. In this range, the high durable press configuration is obtained.

Further, the treating agent of the present invention comprises (i) or (ii) besides a water-soluble inorganic salt, a silicone, a surfactant, a low-molecular polyhydric carboxylic acid, wherein the content of a nonvolatile matter is 0.01 to 30%, preferably 0.1 to 25% and more preferably 0.5 to 15%. The content of a nonvolatile matter is the value based on the treating agent before heating.

In consideration of the vinyl polymer in the same way as described above, the vinyl polymer, further another compound forming a self-crosslinked structure by heating, two or more compounds forming mutually a crosslinked structure by heating, besides a water-insoluble inorganic salt, a silicone, a surfactant, a low-molecular polyhydric carboxylic acid are comprised, wherein the content of a nonvolatile matter is 0.01 to 30%, preferably 0.1 to 25% and more preferably 0.5 to 15%.

If the content of a nonvolatile matter is within the range described above, not only the high durable press configuration is obtained but also a fiber product dried after a treatment doesn't undergo a significant change in whitening, discoloration and feeling in stickiness or rigidness.

In the present invention, the content of a nonvolatile matter is measured in the following method.

<Method of Measuring the Content of a Nonvolatile Matter>

(1) About 20 to 30 g of a drying assistant (i.e. sodium sulfate anhydride well dried at 105° C.) and a stirring bar (with a diameter of about 8 mm and a length of about 80 mm) are placed in a well-dried flat-bottom dish (with an internal diameter of about 50 mm and a height of about 30 mm). Then, their mass is measured accurately.

(2) The treating agent (1.5 to 2.0 g) is placed into the flat-bottom dish described above. Then, its mass (before drying) is measured accurately.

(3) The drying assistant and the treating agent are mixed homogeneously with the stirring bar.

(4) The mixture is placed in an oven (equipped with a stirring device for air at a set temperature of 105±2° C.) and dried for 3 hours.

(5) After drying, the dried mixture is left to be cooled to a room temperature for about 30 minutes in a desiccator (in which a drying agent of silica gel is placed).

(6) After drying and cooling, the mass (after drying) of the flat-bottom dish is measured accurately. Then, the ratio of the content of a nonvolatile matter is calculated according to the following equation.

The content of a nonvolatile matter (%)=100−[the mass before drying (g)−the mass after drying (g)]×100÷the amount of the taken treating agent (g)

The treating agent of the present invention at 20° C. has pH of 3.0 to 7.5 and is adjusted to have preferably 3.5 to 7.0 and more preferably 4.0 to 6.5. In this range, fibers don't deteriorate in strength and have a good durable press configuration. The pH may be adjusted by an acid or alkali agent which is publicly known and used for e.g. a fiber-treating agent or by a water-insoluble inorganic salt described below.

By further blending a water-soluble inorganic salt with the treating agent of the present invention, the durable press configuration is improved. "Water-soluble" in the present invention refer to have solubility of at least 0.1 g per 100 g of water at 20° C. Specific examples thereof are alkali metal salts, alkaline earth salts or amine salts with an acid selected from phosphorus-containing acids such as phosphorous acid, hypophosphorous acid, phosphoric acid and polyphosphoric acid, boron-containing acids such as boric acid and metaboric acid, silicon-containing acids such as silicic acid and metasilicic acid, and sulfur-containing acids such as sulfuric acid, sulfurous acid and thiosulfuric acid. In the present invention, sodium or potassium phosphate, hypophosphite, phosphate and polyphosphoate are particularly preferable in view of improving the durable press configuration. The treating agent of the present invention comprises the water-soluble inorganic salt in an amount of preferably 0.005 to 10 percent by mass, more preferably 0.05 to 7.5 percent by mass and most preferably 0.1 to 5 percent by mass.

In the present invention, the ratio by mass of the water-soluble inorganic salt to the total amount of (i) and/or (ii) described above, particularly the vinyl polymer described above, namely [the total amount of (i) and/or (ii) described above, particularly the vinyl polymer]:the water-soluble inorganic salt, is preferably from 1:0 to 1:1, more preferably from 1:0.05 to 1:0.5 and most preferably from 1:0.1 to 1:0.3 in view of improving the durable press configuration. For efficient formation of a crosslinked structure, it is good that the mass of the water-soluble inorganic salt doesn't exceed the total amount of (i) and/or (ii) described above, particularly the mass of the vinyl polymer described above.

The treating agent of the present invention is further blended preferably with a silicone compound to improve the durable press configuration. Specific examples thereof include dimethyl polysiloxane oil, dimethyl polysiloxane oil having a hydroxyl group at a part of a side-chain or a terminal thereof, and modified silicone oil having an organic group introduced into dimethyl polysiloxane oil or hydroxyl group-containing dimethyl polysiloxane oil. The organic group introduced for obtaining the modified silicone oil includes amino group, amide group, polyether group, epoxy group, carboxy group, alkyl group and poly(N-acylalkylene imine) chain.

The silicone compound can be emulsified with an emulsifier to be used. As the emulsifier, an arbitrary combination of one or more nonionic surfactants, anionic surfactants, cationic surfactants and amphoteric surfactants is preferably used.

Further, it may be self-emulsified without an emulsifier by introducing a hydrophilic modifying group such as polyether group into silicone oil to be used.

The silicone compound described above is available one as it is or an emulsified silicone preparation. For example, BY22-029 or the like is available as a dimethyl polysiloxane emulsion from Toray Dow Corning Silicone. For instance, SM8704C is available from Toray Dow Corning Silicone as hydroxyl group-containing dimethyl polysiloxane oil to which an amino group is introduced. Then, X-61-689 is available from Shin-Etsu Chemical Industry Co., Ltd. as dimethyl polysiloxane oil to which an amino group and a polyether group are introduced.

In any case, the treating agent of the present invention comprises the silicone compound in an amount of preferably 0.005 to 7.5 percent by mass, more preferably 0.01 to 5 percent by mass and most preferably 0.05 to 2.5 percent by mass.

Further, the treating agent of the present invention comprises a low-molecular polyhydric carboxylic acid and a nonionic surfactant in order to further improve the durable press configuration.

The low-molecular polyhydric carboxylic acid is an organic acid having at least two carboxy groups in one molecule thereof or a salt thereof. It is preferably an organic acid having at least two carboxy groups bound respectively to adjacent (neighboring or vicinal) carbon atoms or a salt thereof. The molecular weight of such acid is 116 to 1,000, preferably 116 to 800 and more preferably 116 to 500. This compound includes succinic acid, maleic acid, citric acid, fumaric acid, tartaric acid, malic acid, citraconic acid, aconitic acid, itaconic acid, 1,2-cyclopentanedicarboxylic acid, phenylsuccinic acid, 1,2-cyclohexanedicarboxylic acid, 1,2-cyclopentanedicarboxylic acid, 1,2-cycloctanedicarboxylic acid, 1,2-cycloheptanedicarboxylic acid, 1,2-cyclobutanedicarboxylic acid, 2,3-dimethylsuccinic acid, 2,3-diethylsuccinic acid, 2-ethyl-3-methylsuccinic acid, tetramethylsuccinic acid, 3,3-dimethyl-cis-1,2-cyclopropanedicarboxylic acid, 2,3-di-tert-butylsuccinic acid, trimellitic acid, 1,2,4-cyclohexanetricarboxylic acid, butanetetracarboxylic acid, cyclopentanetetracarboxylic acid and tetrahydrofuran tetracarboxylic acid. Further, the polyhydric carboxylic acid having a surface-activity includes an alkenylsuccinic acid having 8 to 18 carbon atoms. As these acids, there can be used not only as alkali metal salts or alkaline earth metal salts of a part thereof but also as acid anhydrides such as maleic anhydride and succinic anhydride. Further, two or more members of the acids and the acid anhydrides can be used in combination.

Among these low-molecular polyhydric carboxylic acids, citric acid, maleic acid, tartaric acid, succinic acid, malic acid, 1,2-cyclopentanedicarboxylic acid, 1,2-cyclohexanedicarboxylic acid, cyclopentanetetracarboxylic acid or a salt thereof are particularly preferable in view of improving the durable press configuration.

The treating agent of the present invention comprise such a low-molecular polyhydric carboxylic acid in an amount of preferably 0.01 to 20 percent by mass, more preferably 0.1 to 10 percent by mass and most preferably 0.1 to 5 percent by mass as an acid.

There is selected a nonionic surfactant improving wetting property or penetrating property of the treating agent of the present invention toward a fiber product. Such surfactant preferably includes a polyethylene glycol-based nonionic surfactant such as a polyoxyalkylene (referred to hereinafter as POA) adduct to a $C_{6-18}$ alcohol, a POA adduct to a $C_{6-18}$ alkyl phenol, a POA adduct to a $C_{6-18}$ fatty acid, a POA adduct to an ester of a polyhydric alcohol with a $C_{6-18}$ fatty acid, a POA adduct to a $C_{6-18}$ alkylamine, a POA adduct to a $C_{6-18}$ fatty acid amide, a POA adduct to a fat and/or oil, and a POA adduct to polypropylene glycol. Here, POA is preferably polyoxyethylene or polyoxypropylene wherein the average number of moles added therein is 2 to 100 and preferably 5 to 80.

Further, there may be exemplified a polyhydric alcohol-based nonionic surfactant such as an ester of glycerol with a $C_{6-18}$ fatty acid, an ester of pentaerythritol with a $C_{6-18}$ fatty acid, an ester of sorbitol and/or sorbitan with a $C_{6-18}$ fatty acid, an ester of sucrose with a $C_{6-18}$ fatty acid, a $C_{6-18}$ alkyl ether of a polyhydric alcohol and a $C_{6-18}$ fatty acid amide of alkanolamines.

In any case of the polyethylene glycol- and polyhydric alcohol-based ones, the alcohol, the alkyl group and the fatty acid may be linear or branched. The number of the carbon atoms therein may be a mixture.

The treating agent of the present invention preferably comprises the nonionic surfactant in an amount of 0.001 to 5 percent by mass and particularly 0.01 to 2.5 percent by mass. The content of the total surfactants in the fiber product-treating agent of the present invention is preferably 5 percent by mass or less.

The treating agent of the present invention can be arbitrarily blended as necessary with components, used in a publicly known glue by being sprayed for a cloth, such as wax or its emulsion in order to improve decreasing a friction during ironing; a germicide, an antibacterial agent or a fungicide so as to improve the storage stability; an alcohol or a polyol; or a perfume for making a feeling good at use. The treating agent can comprise 0 to 15 percent by mass of these components.

The balance of the treating agent of the present invention is water which is comprised in amount of preferably 55 to 99.9 percent by mass, more preferably 65 to 99.5 percent by mass and most preferably 75 to 99.5 percent by mass.

The mode at use of the treating agent of the present invention comprises impregnating a fiber product in the treating agent and subsequently treating by heating in order to impart the durable press configuration on the fiber product. The methods of the treatments by impregnating and heating are not particularly limited but the impregnating treatment includes a spraying treatment, a coating treatment and an immersing treatment. In any case thereof, the content of a nonvolatile matter in a treating solution is 0.01 to 30%, preferably 0.1 to 25% and more preferably 0.5 to 15% at the time of conducting the treatment. For the heating treatment, there can be used an iron, a presser for trousers, a pressing machine, etc. In particular, it is easy and preferable that a fiber product is impregnated by the spraying treatment with the treating agent and then heated by an ironing treatment.

For the spraying treatment, there can be used a sprayer such as an aerosol sprayer, a manual-trigger sprayer and a manual-pump sprayer. Among them, the manual-trigger sprayer or manual-pump sprayer is preferable and the manual-trigger sprayer is particularly preferable. It is most preferable in the present invention to use an article in which the fiber product-treating agent is introduced into a vessel equipped with e.g. this sprayer. The constitution of these sprayers is not particularly limited but one spraying 0.1 to 1.5 g, preferably 0.2 to 1.0 g and more preferably 0.25 to 0.8 g of the treating agent by one-time spraying is good. Further, the vessel is preferable to make the treating agent adhere onto an area of 50 to 800 $cm^2$ and preferably 100 to 600 $cm^2$ of a fiber product when the agent is sprayed once from a place apart by 15 cm from a fiber product. For example, it is good in view of spraying mist uniformly and preventing liquid-dripping and -dropping that the pressure-keeping-type trigger as disclosed in JP-U 4-37554 or JP-A 9-122547 is used.

In the present invention, it is preferable in view of the durable press configuration that (i) and/or (ii), particularly the vinyl polymer described above, is made in an amount of 0.01 to 20 g, preferably 0.1 to 15 g and more preferably 0.5 to 10 g on average to uniformly adhere to 100 g of a fiber product by the spraying treatment described above.

In the present invention, as shown above, a fiber product is treated by impregnating itself with the treating agent and then treated by heating at 60 to 300° C. in order to obtain the durable press configuration. The heating treatment can be conducted generally by a widespread means such as an iron, a presser for trousers or a dryer with hot air. Among them, the iron and the presser for trousers are preferable because they can simultaneously conduct the heating treat and a configuration-imparting treatment such as a wrinkle-elimination and a plait- (or pleat-) formation, and the iron is particularly preferable because of easy operation. The temperature of the iron set is a temperature suitable for fiber materials, preferably 120 to 220° C. and more preferably 140 to 200° C. The time of ironing 100 $cm^2$ of a fiber product is preferably 1 to 90 seconds and more preferably 2 to 60 seconds.

Further, a natural drying generally conducted between the impregnating treatment and the heating treatment may arbitrarily be added whereby none of the object of the present invention is disturbed.

In regard to a product configuration of the treating agent of the present invention, the treating agent prepared may be used in the impregnating treatment described above as it is. On the other hand, the product configuration may be a concentrate for preparing the treating agent of the present invention by diluting it with water. As a specific example for preparing the treating agent of the present invention from such a concentrate, there is a method in which water is filled in a vessel such as a laundering receptacle and a washbowl capable of immersing a fiber product therein, then a proper amount of the concentrate measured using e.g. a cap of a vessel accommodating the concentrate is added thereto and mixed therewith to prepare the treating agent of the present invention with which a fiber product is then impregnated, for instance. On the other hand, there is a method in which a proper amount of the concentrate and water are added to such a vessel equipped with the sprayer as describe above and mixed to spray this mixture.

The most preferable method of using the treating agent is a treating method which comprises impregnating a fiber product by a spraying treatment with the treating agent and then conducting a configuration-imparting treatment by heating with an ironing treatment.

The optimum content of the fiber product-treating agent in the present invention and the configuration of an article thereof are shown below.

There is mentioned a liquid treating agent comprising (a) 0.5 to 10 percent by mass of a vinyl copolymer having a monomer unit (A) obtained from a vinyl monomer (A) having a carboxy group selected from (meth) acrylic acid, maleic acid, itaconic acid and maleic anhydride and a monomer unit (B) obtained from a vinyl monomer (B) having a hydroxyl group selected from N-(2-hydroxyethyl) (meth)acrylamide, a POA-added mono(meth)acrylamide, a POA-added mono (meth)allyl ether, 2-hydroxyethyl (meth)acrylate, 3-hydroxypropyl (meth)acrylate and a POA-added mono(meth)acrylate, wherein the sum of these monomers (A) and (B) occupies 70 to 100 mol-% of the constituent monomer units in the polymer, at the equivalent ratio of the carboxy group and the hydroxyl group, namely the carboxy group the hydroxyl group, is from 7:3 to 2:8, (b) 0.1 to 5 percent by mass of a water-soluble inorganic salt selected from sodium hypophosphite, sodium phosphite, sodium phosphate, di-sodium or potassium hydrogenphosphate, sodium or potassium dihydrogenphosphate, sodium sulfate, sodium sulfite and sodium thiosulfate, (c) 0.05 to 2.5 percent (in terms of silicone oil) by mass of dimethyl polysiloxane oil, hydroxyl group-containing dimethyl polysiloxane oil, a modified silicone oil having at least one amino or amide group introduced into dimethyl polysiloxane oil or hydroxyl group-containing dimethyl polysiloxane oil, or an emulsion of these oils, (d) as necessary, a pH adjusting agent selected from sodium or potassium hydroxide, phosphoric acid, sulfuric acid and hydrochloric acid, and the balance (for 100 percent by mass in total) of water, which has pH of 4.0 to 6.5 at 20° C. Further, there is mentioned an article of the fiber product-treating agent, comprising the treating agent filled into a vessel equipped with a trigger-type sprayer.

By impregnating a fiber product with the treating agent therefor of the present invention and subsequently conducting a heating treatment, (i) and/or (ii), particularly the vinyl copolymer described above, can form an intramolecular or intermolecular crosslink to impart the durable press configuration. Accordingly, in the present invention, the fiber product-treating agent can be used for any fiber product if the fiber product can be treated by heating and are actually free of damage with water.

Advantageous Effect of the Invention

According to the present invention, there can be obtained a fiber product-treating agent, which can easily impart an excellent durable press configuration, namely a wrinkle-resistant effect and a durable press effect on the fiber product, with regard to kinds of fibers in a home not only during wearing but also after washing.

EXAMPLES

Synthesis Example 1

Synthesis of a Vinyl Copolymer a-1

114.00 g of maleic anhydride, 130.00 g of water and 116.33 g of an EO-added allyl ether [wherein the number of moles of EO added is 6] were added to a 1-L five-necked flask equipped with a stirrer, a nitrogen inlet pipe, a cooling device and a thermometer. Then, an inside of the flask was heated to the temperature of 70° C. and a solution comprising 48.47 g of a 96-% sodium hydroxide dissolved in 46.53 g of water was added thereto. Further, the inside in the flask was purged (or replaced) with nitrogen and then heated to 98° C. An aqueous initiator solution comprising 65.92 g of a 35-% aqueous hydrogen peroxide and 6.93 g of sodium persulfate was added dropwise to the above-mentioned reaction-flask for 6 hours and the temperature of the inside in the flask was further kept at 98° C. for 4 hours. The weight average molecular weight (converted to a PEG basis) of the obtained copolymer was 21,000 as measured in the following method.

[Method of Measuring the Molecular Weight]

Measurement was carried out by using a GPC under the following conditions:

Columns: G4000PWXL+G2500PWXL supplied from Tosoh Corp.,

Eluent: A mixture of an aqueous solution containing a 0.1-mol/l potassium dihydrogenphosphate and a 1 mol/l-disodium hydrogenphosphate and acetonitrile at the ratio of 9:1 by volume, Detector: Differential refractometer, Flow rate: 1.0 mL/minute, Column (measurement) temperature: 40° C., Standard samples: PEG ($9.20\times10^5$, $5.10\times10^5$, $2.50\times10^5$, $9.50\times10^4$, $4.60\times10^4$, $3.90\times10^4$).

Sample concentration: 5 mg/mL, and

Injection volume of eluent sample: 100 $\mu$l.

The molecular weight converted to PEG was calculated using a calibration curve obtained from the above-mentioned standard sample. For a sample having a molecular weight outside of this range in the calibration curve, its converted molecular weight was calculated by extrapolation of the calibration curve.

Synthesis Example 2

Synthesis of a Vinyl Copolymer a-2

78.40 g of maleic anhydride, 166.00 g of water and 87.60 g of an EOPO-added allyl ether [wherein the number of moles of EO added is 6 and that of PO added is 2 and which is tri-block type: allyl ether $(EO)_2(PO)_2(EO)_4$] were added to a 1-L five-necked flask equipped with a stirrer, a nitrogen inlet pipe, a cooling device and a thermometer. Then, an inside of the flask was heated to the temperature of 70° C. and a solution comprising 28.33 g of a 96-% sodium hydroxide dissolved in 66.34 g of water was added thereto. Further, the inside in the flask was purged with nitrogen and then heated to 98° C. An aqueous initiator solution comprising 42.74 g of a 35-% aqueous hydrogen peroxide and 4.76 g of sodium persulfate was added dropwise to the above-mentioned reaction-flask for 6 hours and the temperature of the inside in the flask was further kept at 98° C. for 4 hours. The weight average molecular weight (converted to a PEG basis) of the obtained copolymer was 20,000 as measured by the manner described in Synthesis Example 1.

Synthesis Example 3

Synthesis of a Vinyl Copolymer a-3

156.80 g of maleic anhydride, 308.80 g of water and 152.00 g of an EOPO-added allyl ether [wherein the number of moles of EO added is 6 and that of PO added is 1 and which is tri-block type: allyl ether $(EO)_2(PO)_1(EO)_4$] were added to a 1-L five-necked flask equipped with a stirrer, a nitrogen inlet pipe, a cooling device and a thermometer. Then, an inside of the flask was heated to the temperature of 70° C. and 120.00 g of a 48-% aqueous solution of sodium hydroxide were added thereto. Further, the inside in the flask was purged with nitrogen and then heated to 98° C. An aqueous initiator solution comprising 85.49 g of a 35-% aqueous hydrogen peroxide and 9.53 g of sodium persulfate was added dropwise to the above-mentioned reaction-flask for 6 hours and the temperature of the inside in the flask was further kept at 98° C. for 4 hours. The weight average molecular weight (converted to a PEG basis) of the obtained copolymer was 15,000 as measured by the manner described in Synthesis Example 1.

Synthesis Example 4

Synthesis of a Vinyl Copolymer a-4

156.80 g of maleic anhydride, 360.00 g of water and 140.40 g of an EOPO-added allyl ether [wherein the number of moles of EO added is 6 and that of PO added is 0.5 and which is tri-block type: allyl ether $(EO)_2(PO)_{0.5}(EO)_4$] were added to a 1-L five-necked flask equipped with a stirrer, a nitrogen inlet pipe, a cooling device and a thermometer. Then, an inside of the flask was heated to the temperature of 70° C. and 120.00 g of a 48-% aqueous solution of sodium hydroxide were added thereto. Further, the inside in the flask was purged with nitrogen and then heated to 98° C. An aqueous initiator solution comprising 85.49 g of a 35-% aqueous hydrogen peroxide and 9.53 g of sodium persulfate was added dropwise to the above-mentioned reaction-flask for 6 hours and the temperature of the inside in the flask was further kept at 98° C. for 4 hours. The weight average molecular weight (converted to a PEG basis) of the obtained copolymer was 18,000 as measured by the manner described in Synthesis Example 1.

Synthesis Example 5

Synthesis of a Vinyl Copolymer a-5

156.80 g of maleic anhydride, 308.80 g of water and 152.20 g of an EOPO-added allyl ether [wherein the number of moles of EO added is 6 and that of PO added is 1 and which is random type: allyl ether $(EO/PO)_7$] were added to a 1-L five-necked flask equipped with a stirrer, a nitrogen inlet pipe, a cooling device and a thermometer. Then, an inside of the flask was heated to the temperature of 70° C. and 120.00 g of a 48-% aqueous solution of sodium hydroxide were added thereto. Further, the inside in the flask was purged with nitrogen and then heated to 98° C. An aqueous initiator solution comprising 85.49 g of a 35-% aqueous hydrogen peroxide and 9.53 g of sodium persulf ate was added dropwise to the above-mentioned reaction-flask for 6 hours and the temperature of the inside in the flask was further kept at 98° C. for 4 hours. The weight average molecular weight (converted to a PEG basis) of the obtained copolymer was 18,000 as measured by the manner described in Synthesis Example 1.

Synthesis Example 6

Synthesis of a Vinyl Copolymer a-6

127.38 g of maleic anhydride, 370.66 g of water and 243.28 g of an EOPO-added allyl ether [wherein the number of moles of EO added is 6 and that of PO added is 1 and which is tri-block type: allyl ether $(EO)_2(PO)_1(EO)_4$] were added to a 1-L five-necked flask equipped with a stirrer, a nitrogen inlet pipe, a cooling device and a thermometer. Then, an inside of the flask was heated to a temperature of 70° C. and 97.49 g of a 48-% aqueous solution of sodium hydroxide were added thereto. Further, the inside in the flask was purged with nitrogen and then heated to 98° C. A monomer solution comprising 12.44 g of 2-acrylamide-2-methylpropanesulfonic acid and 50.00 g of water and an aqueous initiator solution comprising 94.23 g of a 35-% aqueous hydrogen peroxide and 9.24 g of sodium persulfate were simultaneously added dropwise to the above-mentioned reaction-flask for 6 hours and the temperature of the inside in the flask was further kept at 98° C. for 4 hours. The weight average molecular weight (converted to a PEG basis) of the obtained copolymer was 18,000 as measured by the manner described in Synthesis Example 1.

Synthesis Example 7

Synthesis of a Vinyl Copolymer a-7

88.20 g of maleic anhydride, 506.20 g of water and 418.00 g of an EOPO-added allyl ether [wherein the number of moles of EO added is 6 and that of PO added is 1 and which is tri-block type: allyl ether $(EO)_2(PO)_1(EO)_4$] were added to a 1-L five-necked flask equipped with a stirrer, a nitrogen inlet pipe, a cooling device and a thermometer. Then, an inside of the flask was heated to the temperature of 70° C. and 67.50 g of a 48-% aqueous solution of sodium hydroxide were added thereto. Further, the inside in the flask was purged with nitrogen and then heated to 98° C. An aqueous initiator solution comprising 116.57 g of a 35-% aqueous hydrogen peroxide and 9.53 g of sodium persulfate was added dropwise to the above-mentioned reaction-flask for 6 hours and the temperature of the inside in the flask was further kept at 98° C. for 4 hours. The weight average molecular weight (converted to a PEG basis) of the obtained copolymer was 15,000 as measured by the manner described in Synthesis Example 1.

Synthesis Example 8

Synthesis of a Vinyl Copolymer a-8

156.80 g of maleic anhydride and 302.84 g of water were added to a 1-L five-necked flask equipped with a stirrer, a nitrogen inlet pipe, a cooling device and a thermometer. Then, an inside of the flask was heated to the temperature of 70° C. and 120.00 g of a 48-% aqueous solution of sodium hydroxide were added thereto. Further, the inside in the flask was purged with nitrogen and then heated to 98° C. A monomer solution comprising 46.04 g of N-(2-hydroxyethyl)acrylamide and an aqueous initiator solution comprising 116.57 g of a 35-% aqueous hydrogen peroxide and 9.53 g of sodium persulf ate were simultaneously added dropwise to the above-mentioned reaction-flask for 6 hours and the temperature of the inside in the flask was further kept at 98° C. for 4 hours. The weight average molecular weight (converted to a PEG basis) of the obtained copolymer was 35,000 as measured by the manner described in Synthesis Example 1.

Synthesis Example 9

Synthesis of a Vinyl Copolymer a-9

78.40 g of maleic anhydride and 216.52 g of water were added to a 1-L five-necked flask equipped with a stirrer, a nitrogen inlet pipe, a cooling device and a thermometer. Then, an inside of the flask was heated to the temperature of 70° C. and 66.67 g of a 48-% aqueous solution of sodium hydroxide were added thereto. Further, the inside in the flask was purged with nitrogen and then heated to 98° C. A monomer solution comprising 138.12 g of N-(2-hydroxyethyl)acrylamide and an aqueous initiator solution comprising 116.57 g of a 35-% aqueous hydrogen peroxide and 9.53 g of sodium persulfate were simultaneously added dropwise to the above-mentioned reaction-flask for 6 hours and the temperature of the inside in the flask was further kept at 98° C. for 4 hours. The weight average molecular weight (converted to a PEG basis) of the obtained copolymer was 30,000 as measured by the manner described in Synthesis Example 1.

Synthesis Example 10

Synthesis of a Vinyl Copolymer a-10

384.00 g of an EO-added allyl ether [wherein the number of moles of EO added is 8] and 441.67 g of water were added to a 1-L five-necked flask equipped with a stirrer, a nitrogen inlet pipe, a cooling device and a thermometer. Then, the inside of the flask was purged with nitrogen and heated to the temperature of 90° C. An aqueous monomer solution comprising 57.67 g of acrylic acid and 53.33 g of a 48-% aqueous solution of sodium hydroxide and an aqueous initiator solution comprising 116.57 g of a 35-% aqueous hydrogen peroxide and 9.53 g of sodium persulfate were simultaneously added dropwise to the above-mentioned reaction-flask for 6 hours and the temperature of the inside in the flask was further kept at 98° C. for 4 hours. The weight average molecular weight (converted to a PEG basis) of the obtained copolymer was 40,000 as measured by the manner described in Synthesis Example 1.

Synthesis Example 11

Synthesis of a Vinyl Copolymer a-11

418.00 g of an EOPO-added allyl ether [wherein the number of moles of EO added is 6 and that of PO added is 1 and which is tri-block type: allyl ether $(EO)_2(PO)_1(EO)_4$] and 475.67 g of water were added to a 1-L five-necked flask equipped with a stirrer, a nitrogen inlet pipe, a cooling device and a thermometer. Further, an inside of the flask was heated to the temperature of 70° C. under an atmosphere of nitrogen. Then, a monomer solution comprising 57.67 g of acrylic acid, 53.33 g of a 48-% aqueous solution of sodium hydroxide and 9.91 g of N,N-dimethylacrylamide and an aqueous initiator solution comprising 116.57 g of a 35-% aqueous hydrogen peroxide and 9.53 g of sodium persulfate were simultaneously added dropwise to the above-mentioned reaction-flask for 6 hours and the temperature of the inside in the flask was further kept at 98° C. for 4 hours. The weight average molecular weight (converted to a PEG basis) of the obtained copolymer was 40,000 as measured by the manner described in Synthesis Example 1.

Synthesis Example 12

Synthesis of a Vinyl Copolymer a-12

475.00 g of water and 25.00 g of isopropyl alcohol (referred to hereinafter as IPA) were added to a 1-L five-necked flask equipped with a stirrer, a nitrogen inlet pipe, a cooling device and a thermometer. Further, an inside of the flask was heated to the temperature of 75° C. under an atmosphere of nitrogen. Then, a monomer solution comprising 64.88 g of acrylic acid and 143.00 g of N-(3-hydroxypropyl)acrylamide and an aqueous initiator solution comprising 0.95 g of sodium persulfate and 50.00 g of water were simultaneously added dropwise thereto for 2 hours and the temperature of the inside in the flask was kept at 75° C. for 4 hours to be further polymerized. The obtained reaction solution was concentrated at 75° C. under a reduced pressure (10,600 to 13,300 Pa) until no further IPA was distilled away, whereby an aqueous polymer solution having a transparent appearance was obtained. The weight average molecular weight (converted to a PEG basis) of the obtained copolymer was 120,000 as measured by the manner described in Synthesis Example 1.

Synthesis Example 13

Synthesis of a Vinyl Copolymer a-13

475.00 g of water and 25.00 g of IPA were added to a 1-L five-necked flask equipped with a stirrer, a nitrogen inlet pipe, a cooling device and a thermometer. Further, an inside of the flask was heated to the temperature of 75° C. under an atmosphere of nitrogen. Then, a monomer solution comprising 57.67 g of acrylic acid, 143.00 g of N-(3-hydroxypropyl) acrylamide and 9.91 g of N,N-dimethylacrylamide and an aqueous initiator solution comprising 0.95 g of sodium persulf ate and 50.00 g of water were respectively added dropwise thereto for 2 hours and the temperature of the inside in the flask was kept at 75° C. for 4 hours to be further polymerized. The obtained reaction solution was concentrated at 75° C. under a reduced pressure (10,600 to 13,300 Pa) until no further IPA was distilled away, whereby an aqueous polymer solution having a transparent appearance was obtained. The weight average molecular weight (converted to a PEG basis) of the obtained copolymer was 100,000 as measured by the manner described in Synthesis Example 1.

Synthesis Example 14

Synthesis of a Vinyl Copolymer aa-1

An inside of a 1-L five-necked flask equipped with a stirrer, a nitrogen inlet pipe, a cooling device and a thermometer was purged with nitrogen. Then, 156.80 g of maleic anhydride, 21.20 g of sodium hypophosphite·$1H_2O$ and 202.08 g of deionized water were added thereto, the inside of the flask was heated to the temperature of 70° C., and 133.33 g of a 48-% aqueous solution of sodium hydroxide were added thereto. Further, the inside of the flask was heated to the temperature of 80° C., a monomer comprising 45.28 g of 2-hydroxyethyl acrylate and an aqueous initiator solution comprising 85.49 g of a 35-% aqueous hydrogen peroxide were respectively added dropwise to the above-mentioned reaction-flask for 6 hours, and the inside in the flask was further kept at 80° C. for 4 hours. The weight average molecular weight (converted to a PEG basis) of the obtained copolymer was 35,000 as measured by the manner described in Synthesis Example 1.

Synthesis Example 15

Synthesis of a Vinyl Copolymer aa-2

An inside of a 1-L five-necked flask equipped with a stirrer, a nitrogen inlet pipe, a cooling device and a thermometer was purged with nitrogen. Then, 58.80 g of maleic anhydride, 21.20 g of sodium hypophosphite·$1H_2O$ and 217.28 g of deionized water were added thereto, the inside of the flask was heated to the temperature of 80° C., and 50.00 g of a 48-% aqueous solution of sodium hydroxide were added thereto. Further, the inside of the flask was heated to the temperature of 80° C., a monomer comprising 158.48 g of 2-hydroxyethyl acrylate and an aqueous initiator solution comprising 19.42 g of a 35-% aqueous hydrogen peroxide, 4.76 g of sodium persulfate and 30.0 g of water were respectively added dropwise to the above-mentioned reaction-flask for 6 hours, and the inside in the flask was further kept at 80° C. for 4 hours. The weight average molecular weight (converted to a PEG basis) of the obtained copolymer was 41,000 as measured by the manner described in Synthesis Example 1.

Synthesis Example 16

Synthesis of a Vinyl Copolymer aa-3

An inside of a 1-L five-necked flask equipped with a stirrer, a nitrogen inlet pipe, a cooling device and a thermometer was purged with nitrogen. Then, 148.96 g of maleic anhydride and 192.00 g of deionized water were added thereto, the inside of the flask was heated to the temperature of 70° C., and 126.67 g of a 48-% aqueous solution of sodium hydroxide were added thereto. Further, the inside of the flask was heated to the temperature of 80° C., and monomers comprising 43.02 g of 2-hydroxyethyl acrylate and 9.91 g of N,N-dimethylacrylamide and an aqueous initiator solution comprising 97.14 g of a 35-% aqueous hydrogen peroxide, 10.62 g of sodium hypophosphite·$1H_2O$ and 50.00 g of deionized water were respectively added dropwise to the above-mentioned reaction-flask for 6 hours, and the inside in the flask was further kept at 80° C. for 4 hours. The weight average molecular weight (converted to a PEG basis) of the obtained copolymer was 48,000 as measured by the manner described in Synthesis Example 1.

Synthesis Example 17

Synthesis of a Vinyl Copolymer aa-4

An inside of a 1-L five-necked flask equipped with a stirrer, a nitrogen inlet pipe, a cooling device and a thermometer was purged with nitrogen. Then, 98.00 g of maleic anhydride and 435.00 g of deionized water were added thereto, the inside of the flask was heated to the temperature of 70° C., and 83.33 g of a 48-% sodium hydroxide were added thereto. Further, the inside of the flask was heated to the temperature of 98° C., and a monomer comprising 336.09 g of a polyoxyethylene-added acrylate (wherein the number of moles of EO added is about 6) and an aqueous initiator solution comprising 85.49 g of a 35-% aqueous hydrogen peroxide, 10.62 g of sodium hypophosphite·$1H_2O$ and 50.00 g of deionized water were respectively added dropwise to the above-mentioned reaction-flask for 6 hours, and the inside in the flask was further kept at 80° C. for 4 hours. The weight average molecular weight (converted to a PEG basis) of the obtained copolymer was 58,000 as measured by the manner described in Synthesis Example 1.

Synthesis Example 18

Synthesis of a Vinyl Copolymer aa-5

100.00 g of deionized water and 400.00 g of IPA were added to a 1-L five-necked flask equipped with a stirrer, a nitrogen inlet pipe, a cooling device and a thermometer. Further, an inside of the flask was heated to the temperature of 75° C. under an atmosphere of nitrogen. Monomers comprising 115.34 g of acrylic acid and 46.44 g of 2-hydroxyethyl acrylate and an aqueous initiator solution comprising 0.95 g of sodium persulfate and 40.00 g of deionized water were respectively added dropwise to the above-mentioned reaction-flask for 2 hours. Further, the temperature of the inside in the flask was kept at 75° C. for 4 hours. The obtained reaction solution was concentrated at 75° C. under a reduced pressure (10,600 to 13,300 Pa) until no further IPA was distilled away, whereby an aqueous polymer solution was obtained. The weight average molecular weight (converted to a PEG basis) of the obtained copolymer was 53,000 as measured by the manner described in Synthesis Example 1.

Synthesis Example 19

Synthesis of a Vinyl Copolymer aa-7

An inside of a 1-L five-necked flask equipped with a stirrer, a nitrogen inlet pipe, a cooling device and a thermometer was purged with nitrogen. Then, 58.80 g of maleic anhydride, 5.31 g of sodium hypophosphite·$1H_2O$ and 236.88 g of deionized water were added thereto, the inside of the flask was heated to the temperature of 70° C., and 83.33 g of a 48-% sodium hydroxide were added thereto. Further, the inside of the flask was heated to the temperature of 98° C., and a monomer comprising 178.08 g of 3-hydroxypropyl acrylate and an aqueous initiator solution comprising 42.75 g of a 35-% aqueous hydrogen peroxide were respectively added dropwise to the above-mentioned reaction-flask for 6 hours, and the inside in the flask was further kept at the reflux temperature for 4 hours. The weight average molecular weight (converted to a PEG basis) of the obtained copolymer was 52,000 as measured by the manner described in Synthesis Example 1.

Synthesis Example 20

Synthesis of a Vinyl Copolymer aa-8

475.00 g of deionized water and 25.00 g of IPA were added to a 1-L five-necked flask equipped with a stirrer, a nitrogen inlet pipe, a cooling device and a thermometer. Further, an inside of the flask was heated to the temperature of 75° C. under an atmosphere of nitrogen. Monomers comprising 7.20 g of acrylic acid and 215.10 g of 2-hydroxyethyl acrylate and an aqueous initiator solution comprising 4.76 g of sodium persulfate and 50.00 g of deionized water were respectively added dropwise to the above-mentioned reaction-flask for 2 hours. Further, the temperature of the inside in the flask was kept at 75° C. for 4 hours. The obtained reaction solution was concentrated at 75° C. under a reduced pressure (10,600 to 13,300 Pa) until no further IPA was distilled away, whereby an aqueous polymer solution was obtained. The weight average molecular weight (converted to a PEG basis) of the obtained copolymer was 175,000 as measured by the manner described in Synthesis Example 1.

Synthesis Example 21

Synthesis of a Vinyl Copolymer aa-9

475.00 g of deionized water and 25.00 g of IPA were added to a 1-L five-necked flask equipped with a stirrer, a nitrogen inlet pipe, a cooling device and a thermometer. Further, an inside of the flask was heated to the temperature of 75° C. under an atmosphere of nitrogen. Monomers comprising 136.97 g of acrylic acid and 11.32 g of 2-hydroxyethyl acrylate and an aqueous initiator solution comprising 4.76 g of sodium persulfate and 50.00 g of deionized water were respectively added dropwise to the above-mentioned reaction-flask for 2 hours. Further, the temperature of the inside in the flask was kept at 75° C. for 4 hours. The obtained reaction solution was concentrated at 75° C. under a reduced pressure (10,600 to 13,300 Pa) until no further IPA was distilled away, whereby an aqueous polymer solution was obtained. The weight average molecular weight (converted to a PEG basis) of the obtained copolymer was 150,000 as measured by the manner described in Synthesis Example 1.

Synthesis Example 22

Synthesis of a Vinyl Copolymer b-1

475.00 g of water and 25.00 g of IPA were added to a 1-L five-necked flask equipped with a stirrer, a nitrogen inlet pipe, a cooling device and a thermometer. Further, an inside of the flask was heated to the temperature of 75° C. under an atmosphere of nitrogen. A monomer solution comprising 86.09 g of methacrylic acid and 99.13 g of N,N-dimethylacrylamide and an aqueous initiator solution comprising 0.95 g of sodium persulfate and 50.00 g of water were simultaneously added dropwise thereto for 2 hours, and the temperature of the inside of the flask was kept at 75° C. for 4 hours to be further polymerized. The obtained reaction solution was concentrated at 75° C. under a reduced pressure (10,600 to 13,300 Pa) until no further IPA was distilled away, whereby an aqueous polymer solution was obtained. The weight average molecular weight (converted to a PEG basis) of the obtained copolymer was 175,000 as measured by the manner described in Synthesis Example 1.

Synthesis Example 23

Synthesis of a Vinyl Copolymer b-2

500.00 g of IPA were added to a 1-L five-necked flask equipped with a stirrer, a nitrogen inlet pipe, a cooling device and a thermometer. Further, an inside of the flask was heated to a temperature of 75° C. under an atmosphere of nitrogen. Then, a monomer solution comprising 184.16 g of N-(2-hydroxyethyl)acrylamide and 44.00 g of methyl methacrylate and an aqueous initiator solution comprising 0.99 g of V-65 [a reagent supplied from Wako Pure Chemical Industries, Ltd.] and 50.00 g of IPA were simultaneously added dropwise thereto for 2 hours, and the temperature of the inside in the flask was kept at 75° C. for 4 hours to be further polymerized. The obtained reaction solution was concentrated at 75° C. under a reduced pressure (10,600 to 13,300 Pa) until no further IPA was distilled away, whereby solids were obtained. The weight average molecular weight (converted to a PEG basis) of the obtained copolymer was 50,000 as measured by the manner described in Synthesis Example 1.

Synthesis Example 24

Synthesis of a Vinyl Copolymer b-3

475.00 g of water and 25.00 g of IPA were added to a 1-L five-necked flask equipped with a stirrer, a nitrogen inlet pipe, a cooling device and a thermometer and then an inside of the flask was heated to the temperature of 75° C. under an 17-% atmosphere of nitrogen. A monomer solution comprising 39.00 g of N-(3-hydroxypropyl)acrylamide, 36.05 g of acrylic acid and 118.96 g of N,N-dimethylacrylamide and an aqueous initiator solution comprising 0.95 g of sodium persulfate and 50.00 g of water were simultaneously added dropwise thereto for 2 hours, and the temperature of the inside in the flask was kept at 75° C. for 4 hours to be further polymerized. The obtained reaction solution was concentrated at 75° C. under a reduced pressure (10,600 to 13,300 Pa) until no further IPA was distilled away, whereby an aqueous polymer solution was obtained. The weight average molecular weight (converted to a PEG basis) of the obtained copolymer was 145,000 as measured by the manner described in Synthesis Example 1.

Synthesis Example 25

Synthesis of a Vinyl Polymer b-4

110.00 g of sodium styrenesulfonate (Spinomar NaSS™, 88-% purity, supplied from Tosoh Corporation), 6.60 g of sodium persulfate and 400.00 g of water were added to a 1-L five-necked flask equipped with a stirrer, a nitrogen inlet pipe, a cooling device and a thermometer. Further, the temperature of an inside of the flask was heated to 70° C. under an atmosphere of nitrogen and then kept at 70° C. for 6 hours to be further polymerized, whereby an aqueous polymer solution was obtained. The weight average molecular weight (converted to a PEG basis) of the obtained copolymer was 200,000 as measured by the manner described in Synthesis Example 1.

The vinyl polymers obtained in Synthesis Examples above are shown in Table 1.

TABLE 1

| | Vinyl polymer | | | | | | | |
|---|---|---|---|---|---|---|---|---|
| | Monomer (A) | | Monomer (B) | | Monomer other than monomers (A) and (B) | | Carboxygroup/hydroxyl | Weight average |
| No. | Kind | Mol-% | Kind | Mol-% | Kind | Mol-% | group (the equivalent ratio) | molecular weight |
| a-1 | Maleic acid | 80 | Allyl ether $(EO)_6$ | 20 | — | — | 8.9/1.1 | 21000 |
| a-2 | Maleic acid | 80 | Allyl ether $(EO)_2(PO)_2(EO)_4$ | 20 | — | — | 8.9/1.1 | 20000 |
| a-3 | Maleic acid | 80 | Allyl ether $(EO)_2(PO)_1(EO)_4$ | 20 | — | — | 8.9/1.1 | 15000 |
| a-4 | Maleic acid | 80 | Allyl ether $(EO)_2(PO)_{0.5}(EO)_4$ | 20 | — | — | 8.9/1.1 | 18000 |
| a-5 | Maleic acid | 80 | Allyl ether $[EO/PO]_7$(EO/PO = 6/1) | 20 | — | — | 8.9/1.1 | 18000 |
| a-6 | Maleic acid | 65 | Allyl ether $(EO)_2(PO)_1(EO)_4$ | 32 | 2-Acrylamide-2-methylpropanesulfonic acid | 3 | 8.0/2.0 | 18000 |
| a-7 | Maleic acid | 45 | Allyl ether $(EO)_2(PO)_1(EO)_4$ | 55 | — | — | 6.2/3.8 | 15000 |
| a-8 | Maleic acid | 80 | N-(2-hydroxyethyl) acrylamide | 20 | — | — | 8.9/1.1 | 35000 |
| a-9 | Maleic acid | 20 | N-(2-hydroxyethyl) acrylamide | 80 | — | — | 3.3/6.7 | 30000 |
| a-10 | Acrylic acid | 40 | Allyl ether $(EO)_8$ | 60 | — | — | 4.0/6.0 | 40000 |
| a-11 | Acrylic acid | 40 | Allyl ether $(EO)_2(PO)_1(EO)_4$ | 55 | N,N-Dimethyl acrylamide | 5 | 4.2/5.8 | 40000 |
| a-12 | Acrylic acid | 55 | N-(3-hydroxypropyl)acrylamide | 45 | — | — | 5.5/4.5 | 120000 |
| a-13 | Acrylic acid | 40 | N-(3-hydroxypropyl)acrylamide | 55 | N,N-Dimethyl acrylamide | 5 | 4.2/5.8 | 100000 |
| aa-1 | Maleic acid | 80 | 2-hydroxyethyl acrylate | 20 | — | — | 8.9/1.1 | 35000 |
| aa-2 | Maleic acid | 30 | 2-hydroxyethyl acrylate | 70 | — | — | 4.6/5.4 | 41000 |
| aa-3 | Maleic acid | 76 | 2-hydroxyethyl acrylate | 19 | N,N-Dimethyl acrylamide | 5 | 8.9/1.1 | 48000 |
| aa-4 | Maleic acid | 50 | Polyoxyethylene-added acrylate | 50 | — | — | 4.6/5.4 | 58000 |
| aa-5 | Acrylic acid | 80 | 2-hydroxyethyl acrylate | 20 | — | — | 8/2 | 53000 |
| aa-7 | Maleic acid | 30 | 3-hydroxypropyl acrylate | 70 | — | — | 4.6/5.4 | 52000 |
| aa-8 | Acrylic acid | 5 | 2-hydroxyethyl acrylate | 95 | — | — | 0.5/9.5 | 175000 |
| aa-9 | Acrylic acid | 95 | 2-hydroxyethyl acrylate | 5 | — | — | 9.5/0.5 | 150000 |
| b-1 | Methacrylic acid | 50 | — | — | N-Dimethyl acrylamide | 50 | 10/0 | 175000 |
| b-2 | — | — | N-(2-hydroxyethyl) acrylamide | 80 | Methyl methacrylate | 20 | 0/10 | 50000 |
| b-3 | Acrylic acid | 25 | N-(3-hydroxypropyl) acrylamide | 15 | N,N-Dimethyl acrylamide | 60 | 6.3/3.7 | 145000 |
| b-4 | — | — | — | — | Sodium styrenesulfonate | 100 | — | 200000 |

Formulation Examples c-1, c-2, c-3, c-4, c-5 and c-6 for blending the vinyl polymers obtained in Synthesis Examples described above are shown in Table 2. As shown in Tables 3 and 4, vinyl polymers were blended with the compositions of Formulation Examples in Table 2 so as to obtain the treating agents shown in Tables 3 and 4. The obtained treating agents were used to evaluate the durable press configuration in the following manner. The results are shown in Tables 3 and 4. Table 3 shows the products of the present invention and Table 4 shows the comparative products.

(Preparation of Test-cloths)

Broad #60 of a 100-% cotton (white plain cloth bleached with fluorescence) (available from SENSHOKU SHIZAI COMPANY, LTD. (TANIGASHIRA SHOTEN) was repeated 5 cycles with a cloth detergent Attack™ (supplied from Kao Corp.) in an automatic laundry machine, wherein 1 cycle comprises washing for 12 minutes, rinsing once with stored (stopped, no running or no changed) water, and dehydration for 3 minutes. Then, it was conducted to rinsing with running water for 15 minutes and dehydration for 5 minutes in a domestic laundry machine with two tanks, naturally dried and then cut into 15 cm×25 cm pieces (whose longer direction is parallel with the warp). Thus, the cut pieces were used as test-cloths. A test-cloth was prepared from a 100-% wool texture for suits in the same manner as above except that a cloth light duty detergent Emal™ (supplied from Kao Corp.) was used in place of Attack™.

(Evaluation of the Durable Press Configuration)

The treating agent in Table 3 or 4 was uniformly sprayed on the test-cloth all over by using a spray vial (No. 6, supplied from Maruemn Corporation) so that the treating agent may be 100% o.w.f. (on the weight of fabrics, the mass of the composition as compared with the mass of fabrics). Then, the test-cloth was doubled (or overlapped) with itself at the almost middle in the longer side and rapidly ironed for 60 seconds with a domestic iron (NI-A55 automatic iron, supplied from Matsushita Electric Industrial Co., Ltd.) set for cottons, when the test-cloth was made of cotton, or for wools, when the test-cloth was made of wools. Further, the back of the doubled cloth was subsequently ironed for 60 seconds.

One treating agent treated 3 cloths in the same manner. The treated cloth thus obtained was spread. When it was the cotton test-cloth, it was laundered by washing for 12 minutes, rinsing twice with stored water, and dehydration for 40 seconds, with a standard amount used of the cloth detergent Attack™ in an automatic laundry machine (NA-F50K1, supplied from Matsushita Electric Industrial Co., Ltd.) with a high water level. And then, it was spread and naturally dried with a flat condition as the spread state. On the other hand, when it was the wool test-cloth, it was laundered with a standard amount used of a cloth light duty detergent Emal™ at washing coarse gentle on clothes in the automatic laundry machine (NA-F50K1, supplied from Matsushita Electric Industrial Co., Ltd.) and then naturally dried with a flat condition as the spread state.

These test-cloths after drying and the untreated test-cloths (i.e. which were sprayed with water only and ironed at the same temperature and for the same time as above) were visually judged for the wrinkle-resistant effect and the durable press effect under natural light and relatively evaluated by 5 panelists. Each of the results in the relative evaluation of the wrinkle-resistant effect and the durable press effect was statistically processed by Scheffe's paired comparison method and expressed under the following criteria:

◎: Superior beyond the error range to the untreated cloth,

○: Overlapping with the error range but superior in the median to the untreated cloth, Δ: The median is within the error range of the untreated cloth, and X: Inferior in the median to the untreated cloth.

TABLE 2

| | | | Formulation Examples | | | | | |
|---|---|---|---|---|---|---|---|---|
| | | | c-1 | c-2 | c-3 | c-4 | c-5 | c-6 |
| Contents of Components (percent by mass) | Vinyl polymer | | Tables 3 and 4 | | | | | |
| | Water-soluble inorganic salt | Sodium hypophosphite | — | 1.5 | — | 1.5 | 1.5 | 1.5 |
| | | Sodium dihydrogen-phosphate | — | — | 1.5 | — | — | — |
| | Silicone compound | SM8704C [*1] | — | — | — | 1.0 | — | — |
| | | BY22-019 [*2] | — | — | — | — | 1.0 | — |
| | | X61-689 [*3] | — | — | — | — | — | 1.0 |
| | Propylene gylcol | | 1.0 | 1.0 | 1.0 | 1.0 | 1.0 | 1.0 |
| | Perfume | | 0.01 | 0.01 | 0.01 | 0.01 | 0.01 | 0.01 |
| | Proxel BDN [4] | | 0.015 | 0.015 | 0.015 | 0.015 | 0.015 | 0.015 |
| | pH-adjusting agent [*5] | | Amount for adjusting pHs in Tables 3 and 4 | | | | | |
| | Water | | Balance | Balance | Balance | Balance | Balance | Balance |
| | Sum | | 100 | 100 | 100 | 100 | 100 | 100 |

[*1] Amodimethicone emulsion supplied from Toray Dow Corning Silicone.

[*2] Dimethylpolysiloxane emulsion supplied from Toray Dow Corning Silicone.

[*3] Aminopolyether-modified silicone supplied from Shin-Etsu Chemical Industry Co., Ltd.

[4] 1,2-Benzothiazoline-3-one liquid supplied from Avecia Co.

[*5] NaOH or HCl.

TABLE 3

| | Vinyl polymer | | | | | Cotton | | Wool | |
|---|---|---|---|---|---|---|---|---|---|
| | Kind | Amount to be comprised (percent by mass) | Formulation Examples | Content of a nonvolatile matter in the treating agent (%) | pH (20° C.) | Wrinkle-resistant effect | Durable press effect | Wrinkle-resistant effect | Durable press effect |
| d-1 | a-1 | 4.0 | c-2 | 5.6 | 4.5 | ○ | ○ | ○ | ○ |
| d-2 | a-2 | 4.0 | c-2 | 5.6 | 3.5 | ◎ | ◎ | ◎ | ◎ |
| d-3 | a-2 | 4.0 | c-2 | 5.6 | 4.5 | ○ | ○ | ○ | ○ |
| d-4 | a-2 | 4.0 | c-2 | 5.6 | 7.0 | Δ | Δ | Δ | Δ |
| d-5 | a-3 | 4.0 | c-2 | 5.6 | 4.5 | ○ | ○ | ○ | ○ |
| d-6 | a-3 | 4.0 | c-4 | 6.1 | 4.5 | ◎ | ○ | ◎ | ○ |
| d-7 | a-3 | 4.0 | c-5 | 6.1 | 4.5 | ◎ | ○ | ◎ | ○ |
| d-8 | a-3 | 4.0 | c-6 | 6.6 | 4.5 | ◎ | ○ | ◎ | ○ |
| d-9 | a-4 | 4.0 | c-1 | 4.1 | 4.5 | Δ | Δ | Δ | Δ |
| d-10 | a-4 | 4.0 | c-2 | 5.6 | 4.5 | ○ | ○ | ○ | ○ |
| d-11 | a-4 | 4.0 | c-3 | 5.6 | 4.5 | ○ | ○ | ○ | ○ |
| d-12 | a-5 | 1.5 | c-2 | 3.1 | 4.5 | ○ | Δ | ○ | Δ |
| d-13 | a-5 | 4.0 | c-2 | 5.6 | 4.5 | ○ | ○ | ○ | ○ |
| d-14 | a-5 | 12.0 | c-2 | 13.6 | 4.5 | Δ | ○ | Δ | ○ |
| d-15 | a-6 | 4.0 | c-2 | 5.6 | 4.5 | ○ | ○ | ○ | ○ |
| d-16 | a-7 | 4.0 | c-2 | 5.6 | 4.5 | ○ | ○ | ◎ | ◎ |
| d-17 | a-8 | 4.0 | c-2 | 5.6 | 4.5 | ○ | ○ | ○ | ○ |
| d-18 | a-9 | 4.0 | c-2 | 5.6 | 4.5 | ○ | ○ | ◎ | ◎ |
| d-19 | a-10 | 4.0 | c-2 | 5.6 | 4.5 | Δ | ○ | Δ | ○ |
| d-20 | a-11 | 4.0 | c-2 | 5.6 | 4.5 | Δ | ○ | Δ | ○ |
| d-21 | a-12 | 4.0 | c-2 | 5.6 | 4.5 | Δ | ○ | Δ | ○ |
| d-22 | a-13 | 4.0 | c-2 | 5.6 | 4.5 | Δ | ○ | Δ | ○ |
| d-23 | aa-1 | 4.0 | c-2 | 5.6 | 4.5 | ○ | ○ | ○ | ○ |
| d-24 | aa-2 | 4.0 | c-2 | 5.6 | 4.5 | ○ | ◎ | ○ | ◎ |
| d-25 | aa-3 | 4.0 | c-2 | 5.6 | 4.5 | ○ | ○ | ○ | ○ |
| d-26 | aa-4 | 4.0 | c-2 | 5.6 | 4.5 | ○ | ○ | ○ | ○ |
| d-27 | aa-5 | 4.0 | c-2 | 5.6 | 4.5 | ○ | ○ | Δ | ○ |
| d-28 | aa-7 | 4.0 | c-2 | 5.6 | 4.5 | ○ | ◎ | ○ | ◎ |
| d-29 | aa-8 | 4.0 | c-2 | 5.6 | 4.5 | Δ | Δ | ○ | ○ |
| d-30 | aa-9 | 4.0 | c-2 | 5.6 | 4.5 | ○ | ○ | Δ | Δ |

TABLE 4

| | Vinyl polymer | | | | | Cotton | | Wool | |
|---|---|---|---|---|---|---|---|---|---|
| | Kind | Amount to be comprised (percent by mass) | Formulation Examples | Content of a nonvolatile matter in the treating agent (%) | pH (20° C.) | Wrinkle-resistant effect | Durable press effect | Wrinkle-resistant effect | Durable press effect |
| e-1 | b-1 | 4.0 | c-2 | 5.6 | 4.5 | ○ | ○ | X | X |
| e-2 | b-2 | 4.0 | c-2 | 5.6 | 4.5 | X | X | X | X |
| e-3 | b-3 | 4.0 | c-2 | 5.6 | 4.5 | X | X | X | X |
| e-4 | b-4 | 4.0 | c-2 | 5.6 | 4.5 | X | X | X | X |
| e-5 | a-1 | 0.001 | c-2 | 1.6 | 4.5 | X | X | X | X |
| e-6 | a-1 | 40.0 | c-2 | 41.6 | 4.5 | X | Δ | X | Δ |
| e-7 | a-1 | 4.0 | c-2 | 5.6 | 1.8 | Immeasurable because of breaking the cloth | Immeasurable because of breaking the cloth | Immeasurable because of breaking the cloth | Immeasurable because of breaking the cloth |
| e-8 | a-1 | 4.0 | c-2 | 5.6 | 9.0 | X | X | X | X |

The vinyl copolymers shown in Table 5 were measured for $r^1$ and $r^2$in the requirements (I) and (II) in the method described above. The test-cloth used was a piece cut into 2.0 cm×5.0 cm form a jersey cloth made of a 100-% polyester (available from SENSHOKU SHIZAI COMPANY, LTD. (TANIGASHIRA SHOTEN)), which was humidified at 20° C. under 65% R.H. for 12 hours or more. The heating at 180° C. and drying at 60° C. in the requirements (I) and (II) were carried out in a thermostatic drier (with the temperature set at 180° C.±5° C. and 60° C.±5° C. respectively). The results are shown in Table 5.

TABLE 5

| Vinyl polymer | Requirement (I) $r^1$ (%) | Requirement (II) $r^2$ (%) |
|---|---|---|
| a-1 | 64 | 10 |
| a-2 | 74 | 8 |
| a-7 | 70 | 12 |
| aa-1 | 59 | 13 |
| b-1 | 2 | 15 |
| b-4 | 1 | 11 |

What is claimed is:

1. A treating agent for imparting a durable press configuration on a fiber product selected from the group consisting of chemical fibers and wools by a heating treatment, which comprises 0.01 to 20 percent by mass of a vinyl polymer containing a monomer unit selected from the following monomer units (A), (B) and (C) (provided that if the monomer unit (C) is not selected, both of the monomer units (A) and (B) are selected), wherein the ratio of a sum of the monomer units (A), (B) and (C) is 50 to 100 mol-% of the total constituent monomer units, and the content of a nonvolatile matter is 0.01 to 30%:

the monomer unit (A): a vinyl monomer unit having a carboxy group, which is maleic acid, the monomer unit (B): a vinyl monomer unit having a hydroxyl group, selected from the group consisting of oxyethylene adduct and oxypropylene adduct, and the monomer unit (C): a vinyl monomer unit having a carboxy group and a hydroxyl group;

wherein the vinyl polymer is a polymer capable of forming a self-crosslinked structure by heating, the treating agent possesses a pH at 20° C. of 3.0 to 6.5, and the equivalent ratio of the carboxy group to the hydroxy group is from 7:3 to 2:8, provided that when the vinyl polymer contains the monomer unit (A), said monomer unit (A) is present in a range of less than 50 mol-% in the polymer.

2. The treating agent as claimed in claim 1, which comprises 0.005 to 10 percent by mass of a water-soluble inorganic salt.

3. The treating agent as claimed in claim 1, which comprises 0.005 to 7.5 percent by mass of a silicone compound.

4. A concentrate of the treating agent defined in claim 1, wherein the treating agent is obtained from the concentrate by diluting the concentrate with water.

5. A method of imparting a durable press configuration to a fiber product selected from the group consisting of chemical fibers and wools, which comprises applying, to the fiber product, a treating agent comprising 0.01 to 20 percent by mass of a vinyl polymer containing a monomer unit selected from the following monomer units (A), (B) and (C) (provided that if the monomer unit (C) is not selected, both of the monomer units (A) and (B) are selected), wherein the ratio of a sum of the monomer units (A), (B) and (C) is 50 to 100 mol-% of the total constituent monomer units, and the content of a nonvolatile matter is 0.01 to 30%:

the monomer unit (A): a vinyl monomer unit having a carboxy group, which is maleic acid, the monomer unit (B): a vinyl monomer unit having a hydroxyl group, selected from the group consisting of oxyethylene adduct and oxypropylene adduct, and the monomer unit (C): a vinyl monomer unit having a carboxy group and a hydroxyl group;

wherein the vinyl polymer is a polymer capable of forming a self-crosslinked structure by heating, the treating agent possesses a pH at 20° C. of 3.0 to 6.5, and the equivalent ratio of the carboxy group to the hydroxy group is from 7:3 to 2:8, provided that when the vinyl polymer contains the monomer unit (A), said monomer unit (A) is present in a range of less than 50 mol-% in the polymer, and heating the product while imparting the durable press configuration thereto.

6. The method as claimed in the claim 5, in which the durable press configuration has a resistance to wrinkles, shrinks or creases or a smooth drying property.

7. The method of imparting a durable press configuration to the fiber product as claimed in claim 5, wherein self-crosslinking of the vinyl polymer in the treating agent occurs during the heating of the product.

* * * * *